US005897198A

United States Patent [19]

Hsieh

[11] Patent Number: 5,897,198

[45] Date of Patent: Apr. 27, 1999

[54] RATCHET WRENCH WITH LAMP CIRCUIT MEANS

[76] Inventor: Chih-Ching Hsieh, No. 64, Lane 107, Liang Tsun Rd., Fong Yuan City, Taichung Hsien, Taiwan

[21] Appl. No.: 09/071,954

[22] Filed: May 5, 1998

[51] Int. Cl.[6] ..... B25B 13/46

[52] U.S. Cl. ..... 362/119; 362/202; 81/177.2; 81/177.85

[58] Field of Search ..... 362/119, 202; 81/60, 61, 62, 63.1, 63.2, 63, 479, 177.2, 124.6, 439, 177.5, 177.85

[56] References Cited

U.S. PATENT DOCUMENTS 2,783,364 2/1957 Wood, Jr. ..... 362/119

4,324,158 4/1982 Le Roy ..... 81/60

5,477,434 12/1995 Reed ..... 362/119

*Primary Examiner*—Thomas M. Sember

*Attorney, Agent, or Firm*—Varndell Legal Group

[57] ABSTRACT

A ratchet wrench having a lamp circuit assembly mounted in a stepped longitudinal center through hole defined within a ratchet unit thereof, the lamp circuit assembly including a lamp holder, a battery cell, a metal spring connected between the lamp holder and the battery cell, a switch fastened to the ratchet unit by a screw joint, and a metal contact plate turned with the switch to close/open the circuit of the battery cell so as to turn on/off the lamp holder.

2 Claims, 4 Drawing Sheets

RATCHET WRENCH WITH LAMP CIRCUIT MEANS

BACKGROUND AND SUMMARY OF THE INVENTION

The present invention relates to a ratchet wrench, and more particularly to such a ratchet wrench which has a lamp circuit assembly installed in the ratchet unit thereof, and controlled to emit light by rotating a switch.

A variety of ratchet wrench have been disclosed, and have appeared on the market. These ratchet wrenches are functional, however, they are not practical for use in a dark place. When using a ratchet wrench in a drak place, a flash light is required to provide illumination. However, it is inconvenient to operate a ratchet wrench with one hand when the other hand holding a flash light.

It is one object of the present invention to provide a ratchet wrench which has a lamp circuit assembly installed in the ratchet unit thereof for providing illumination during the operation of the ratchet wrench. It is another object of the present invention to provide a ratchet wrench with a lamp circuit assembly which is controlled to emit light by rotating a switch is fastened to the ratchet unit by a screw joint.

DETAILED DESCRIPTION OF THE PREFERRED EMBODIMENT

Figure 1:
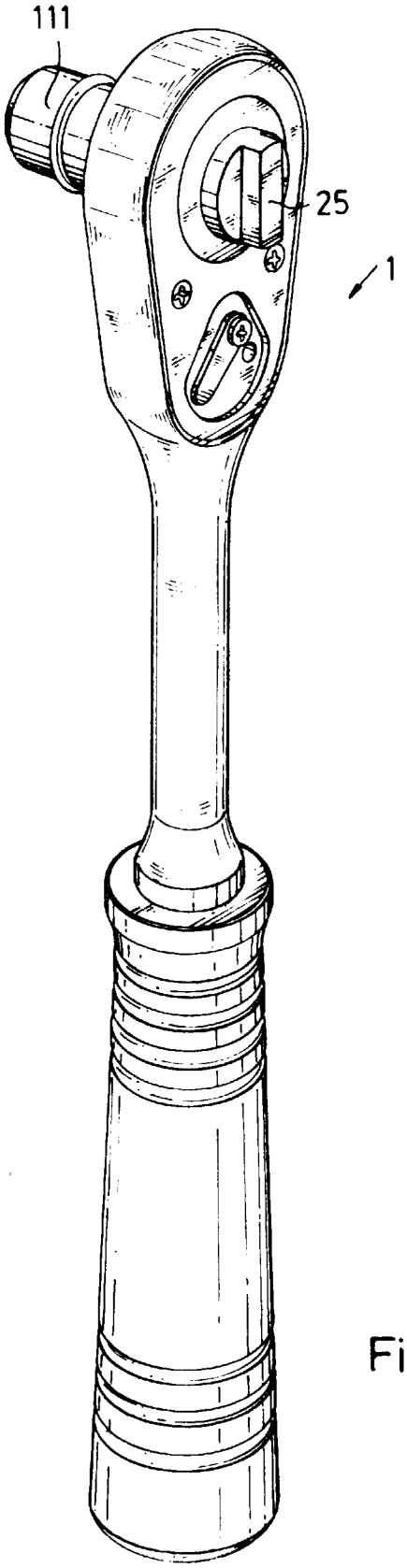
FIG. 1 is a perspective view of ratchet wrench according to the present invention.
Figure 2:
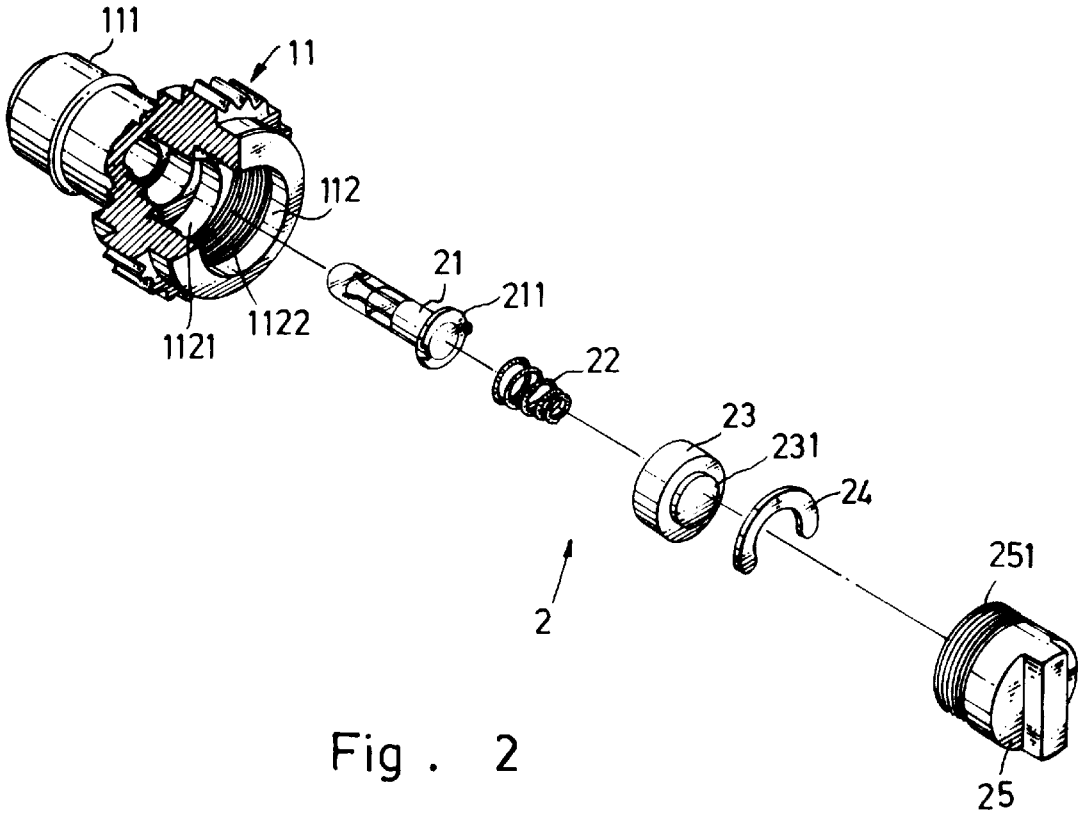
FIG. 2 is a cutaway of the ratchet unit and exploded view of the lamp circuit assembly according to the present invention.
Figure 3:
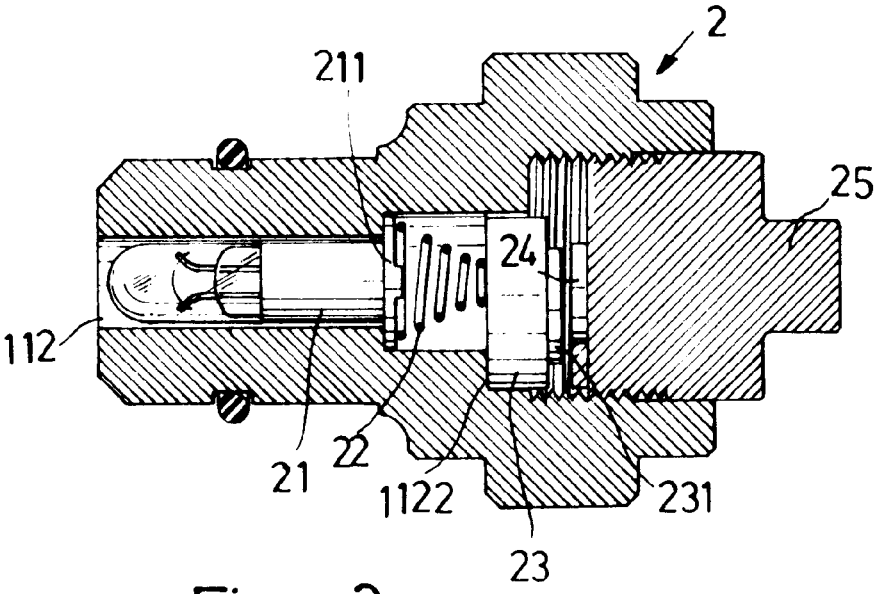
FIG. 3 is a sectional plain view showing the lamp circuit assembly installed in the ratchet unit according to the present invention.
Figure 4:
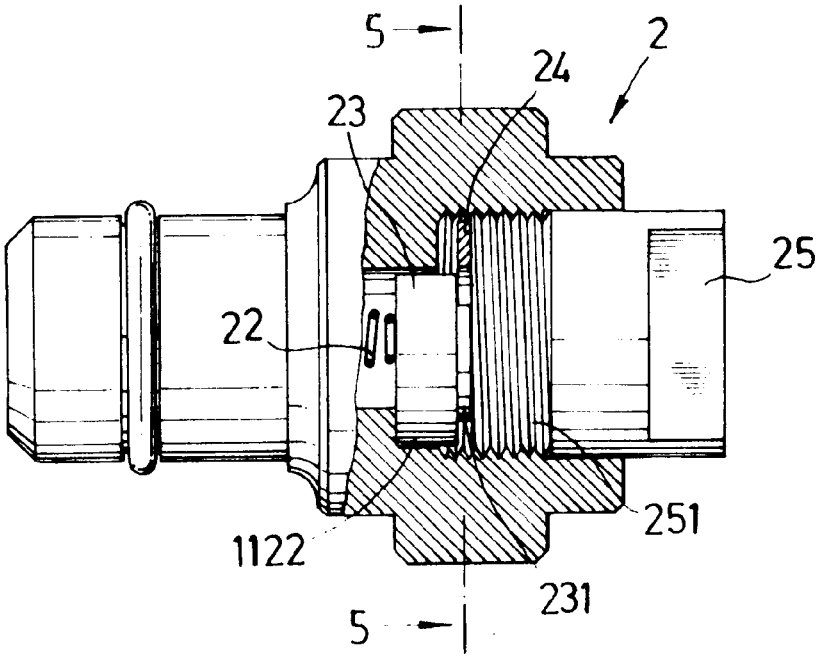
FIG. 4 is a sectional elevation showing the lamp circuit assembly installed in the ratchet unit according to the present invention.
Figure 5:
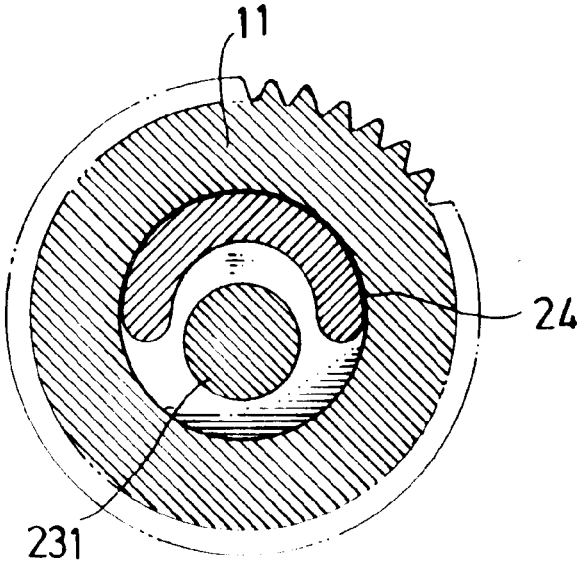
FIG. 5 is a sectional view taken along line 5—5 of FIG. 4.
Figure 6:
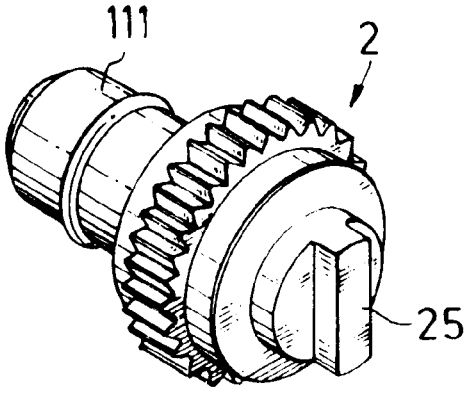
FIG. 6 is a perspective view of the assembly of the ratchet unit and lamp circuit assembly according to the present invention.

Referring to FIGS. from 1 to 6, a ratchet wrench 1 is shown comprising a ratchet unit, which comprises a metal ratchet wheel 11, and a coupling shaft 111 integral with the ratchet wheel 11 at one side. A stepped longitudinal center through hole 112 is defined within the coupling shaft 111 and the ratchet wheel 11. An outer thread 1122 is provided within the greatest diameter of the stepped longitudinal center through hole 112. A locating groove 1121 is provided inside the longitudinal center through hole 112 on the middle. The stepped longitudinal center through hole 112 has different diameters arranged in proper order from the smallest toward the greatest in direction from the coupling shaft 111 toward the ratchet wheel 11. A lamp circuit assembly 2 is mounted in the stepped longitudinal center through hole 112. The lamp circuit assembly 2 is comprised of a lamp holder 21, a metal spring 22, a battery cell 23, a metal contact plate 24, and a switch 25. The lamp holder 21 is mounted in the stepped longitudinal center through hole 112 within the coupling shaft 111, having a contact plate 211 at one side. The battery cell 23 is mounted in the longitudinal center through hole 112, and partially engaged into the locating groove 1121. When the battery cell 23 is installed, the axial center of the battery cell 23 is not in alignment with the longitudinal central axis of the stepped longitudinal center through hole 112. The metal spring 22 is connected between the negative terminal of the battery cell 23 and the contact plate 211 of the lamp holder 21. The switch 25 has an outer thread 251 at one end threaded into the inner thread 1122 in the stepped longitudinal center through hole 112. The opposite end of the switch 25 extends out of the stepped longitudinal center through hole 112 for operation with the hand. The metal contact plate 24 is a horseshoe-like plate welded to one end of the switch 25. When the switch 25 is installed in the stepped longitudinal center through hole 112, the metal contact plate 24 is disposed adjacent to the positive terminal 231 of the battery cell 23. By means of rotating the switch 25, the circuit of the lamp circuit assembly 2 is turned on/off.

I claim:

1. A ratchet wrench comprising a ratchet wheel, a coupling shaft integral with said ratchet wheel at one side, a stepped longitudinal center through hole defined within said ratchet wheel and said coupling shaft, a lamp circuit assembly mounted in said stepped longitudinal center through hole and controlled to emit light, wherein an inner thread is provided at one end of said stepped longitudinal center through hole remote from said coupling shaft; said lamp circuit assembly comprises a lamp holder mounted in said stepped longitudinal center through hole at one end within said coupling shaft, a battery cell mounted within said stepped longitudinal center through hole, a metal spring connected between one end of said lamp holder and a negative terminal of said battery cell, a switch having an outer thread at one end threaded into the inner thread in said stepped longitudinal center through hole, and a horseshoe-like metal contact plate welded to said switch and turned with said switch to connect/disconnect a positive terminal of said battery cell, causing said lamp holder to be electrically turned on/off.

2. The ratchet wrench of claim 1 wherein said ratchet wheel comprises a locating groove within said stepped longitudinal center through hole at one side, said locating groove receiving a part of said battery center to hold said battery center at an eccentric position within said stepped longitudinal center through hole.

* * * * *